US006488612B2

(12) United States Patent
Sechrest et al.

(10) Patent No.: US 6,488,612 B2
(45) Date of Patent: Dec. 3, 2002

(54) MULTIPLE EXERCISE APPARATUS HAVING AN ADJUSTABLE ARM MECHANISM

(75) Inventors: Scott Sechrest, Providence, RI (US); Raymond Giannelli, Franklin, MA (US); Stephen C. Wendt, Owatonna, MN (US); Scott Lee, Pomfret, CT (US)

(73) Assignee: Cybex International, Inc., Medway, MA (US)

( * ) Notice: Subject to any disclaimer, the term of this patent is extended or adjusted under 35 U.S.C. 154(b) by 0 days.

(21) Appl. No.: 09/800,211

(22) Filed: Mar. 5, 2001

(65) Prior Publication Data

US 2002/0013200 A1 Jan. 31, 2002

Related U.S. Application Data

(60) Provisional application No. 60/187,368, filed on Mar. 6, 2000.

(51) Int. Cl.[7] ..... A63B 21/062

(52) U.S. Cl. ..... 482/103; 482/138; 482/908

(58) Field of Search ..... 482/93, 94, 97–103, 482/110, 134, 136, 138, 139, 129, 130, 135, 908

(56) References Cited

U.S. PATENT DOCUMENTS

| | | | | | |
|---|---|---|---|---|---|
| 2,356,260 | A | * | 8/1944 | Maxwell | 482/129 |
| 3,306,611 | A | | 2/1967 | Gaul | |
| 3,640,527 | A | | 2/1972 | Proctor | |
| 4,346,888 | A | | 8/1982 | Szabo | |
| 4,600,189 | A | | 7/1986 | Olschansky et al. | |
| 4,603,855 | A | | 8/1986 | Sebelle | |
| 4,635,926 | A | | 1/1987 | Minkow | 272/118 |
| 4,709,918 | A | | 12/1987 | Grinblat | 272/97 |
| 4,721,303 | A | | 1/1988 | Fitzpatrick | |
| 4,735,167 | A | | 4/1988 | White et al. | 114/230 |
| 4,826,157 | A | * | 5/1989 | Fitzpatrick | 482/103 |
| 4,898,381 | A | | 2/1990 | Gordon | |
| 5,044,629 | A | * | 9/1991 | Ryan et al. | 482/101 |
| 5,064,191 | A | | 11/1991 | Johnson | 272/117 |
| 5,090,694 | A | * | 2/1992 | Pauls et al. | 482/138 |
| 5,094,449 | A | * | 3/1992 | Stearns | 482/100 |
| 5,102,122 | A | | 4/1992 | Piane, Jr. et al. | |
| 5,242,344 | A | | 9/1993 | Hundley | 482/93 |
| 5,348,524 | A | | 9/1994 | Grant | 482/130 |
| 5,362,296 | A | | 11/1994 | Wang et al. | 482/133 |
| 5,486,150 | A | * | 1/1996 | Randolph | 482/137 |
| 5,709,638 | A | | 1/1998 | Mackert et al. | 482/130 |
| 5,758,785 | A | | 6/1998 | Spinosa et al. | 212/300 |
| 5,800,321 | A | | 9/1998 | Webber | 482/103 |
| 5,961,427 | A | | 10/1999 | Habling et al. | 482/96 |
| D428,949 | S | | 8/2000 | Simonson | |
| 6,238,323 | B1 | * | 5/2001 | Simonson | 482/103 |

FOREIGN PATENT DOCUMENTS

| | | | | |
|---|---|---|---|---|
| SU | 1586724 A1 | * | 8/1990 | 482/103 |
| SU | 1743620 A1 | * | 6/1992 | 482/102 |
| WO | 97/14475 | | 4/1997 | |

OTHER PUBLICATIONS

CYBEX FT 360 product brochure, Cybex International, Inc.*

* cited by examiner

*Primary Examiner*—Glenn E. Richman
*Assistant Examiner*—Victor Hwang
(74) *Attorney, Agent, or Firm*—Christopher & Weisberg P.A.

(57) ABSTRACT

A multiple exercise performance or positioning apparatus comprising a generally upright stationary frame on which is mounted an elongated arm mechanism which is mounted on a pivot mechanism, the arm mechanism extending from a proximal end to a distal end relative to the frame, the pivot mechanism enabling pivoting of the arm mechanism such that the distal end of the arm mechanism is adjustably movable between positions of variable distance away from the frame, wherein a cable mechanism is mounted around one or more pulleys, the cable mechanism having a first end interconnected to a handle mechanism which is mounted at the distal end of the elongated arm mechanism, the cable mechanism being interconnected to a weight resistance mechanism such that a user may grasp and pull the handle mechanism against an opposing force exerted by the weight resistance mechanism through the cable mechanism.

2 Claims, 7 Drawing Sheets

MULTIPLE EXERCISE APPARATUS HAVING AN ADJUSTABLE ARM MECHANISM

This application claims priority under 35 USC Section 119 to the following: U.S. Provisional Patent Application Serial No. 60/187,368 entitled Functional Trainer, filed Mar. 6, 2000, the disclosure of which is incorporated herein by reference in its entirety.

BACKGROUND

Multi functional physical exercise apparati have been designed in the past to incorporate a variety of different subassemblies into a single machine which enable the user to perform a variety of different exercises different for each subassembly. Such conventional multi functional exercise machines provide a limited number of available exercise routines which themselves are limited in the ranges and types of motions that the user may perform.

SUMMARY OF THE INVENTION

The present invention relates to exercise apparati generally and more particularly to an exercise apparatus which enables multiple exercise routines in various positions to exercise various muscles or muscle groups at a single station. The apparatus comprises a central support which anchors at least one and typically at least two arm members which are fixedly attached to the support in a spaced apart relationship such that a user/subject may, at a single location or station, engage a grip or handle provided at the end of each arm, the grip or handle being interconnected to a weight resistance mechanism such as a weight stack or a free weight.

The arm(s) are connected to the support in such a manner as to enable the arm(s) to be both rotated and pivoted/tilted. Typically, the arm(s) are rotatable between zero and 180 degree positions in increments (such as increments of twenty degrees) and, typically, the arm(s) are pivotable between zero and forty-five degrees in increments (such as increments of fifteen degrees), wherein the incremental rotation and pivot positions are selectable and reversibly lockable into such incrementally located rotated and pivoted positions by the user.

In accordance with the invention there is provided, a multiple exercise performance or positioning apparatus comprising a generally upright stationary frame on which is mounted an elongated arm mechanism which is mounted on a pivot mechanism, the arm mechanism extending from a proximal end to a distal end relative to the frame, the pivot mechanism enabling pivoting of the arm mechanism such that the distal end of the arm mechanism is adjustably movable between positions of variable distance away from the frame, wherein a cable mechanism is mounted around one or more pulleys, the cable mechanism having a first end interconnected to a handle mechanism which is mounted at the distal end of the elongated arm mechanism, the cable mechanism being interconnected to a weight resistance mechanism such that a user may grasp and pull the handle mechanism against an opposing force exerted by the weight resistance mechanism through the cable mechanism.

In accordance with the invention there is provided, a multiple exercise performance apparatus comprising a generally upright stationary frame on which is mounted first and second elongated arm mechanisms for pivoting about first and second pivot axes, the arm mechanisms each extending from a proximal end to a distal end relative to the frame, wherein a cable mechanism is mounted around one or more pulleys, the cable mechanism having a first terminal end interconnected to a handle mechanism which is mounted at the distal end of the first elongated arm mechanism, and a second terminal end interconnected to a handle mechanism which is mounted at the distal end of the second elongated arm mechanism, the cable mechanism having a second end interconnected to a weight resistance mechanism such that a user may grasp and pull at least one of the handle mechanisms against an opposing force exerted by the weight resistance mechanism through the cable mechanism.

In accordance with the invention there is provided, a multiple exercise performance apparatus comprising a generally upright stationary frame having a pair of opposing sides and a front face, wherein at least one elongated arm mechanism is mounted on the frame mechanism for rotation about an axis extending forwardly from the front face, the arm mechanism extending forwardly from a proximal end to a distal end relative to the front face, wherein a cable mechanism is mounted around one or more pulleys, the cable mechanism having a first terminal end interconnected to a handle mechanism which is mounted at the distal end of the first elongated arm mechanism, and a second terminal end interconnected to a handle mechanism which is mounted at the distal end of the elongated arm mechanism, the cable mechanism being interconnected to a weight resistance mechanism such that user may grasp and pull the handle mechanism against an opposing force exerted by the weight resistance mechanism through the cable mechanism.

In accordance with the invention there is provided, a multiple exercise performance apparatus comprising a generally upright stationary frame on which is mounted an elongated arm mechanism for rotation about a generally horizontal axis, the arm mechanism extending from a proximal end to a distal end relative to the frame, the elongated arm mechanism being mounted to a rotatable member which rotates around the generally horizontal axis, the rotatable member being interconnected to a rotation damping mechanism, wherein a cable mechanism is mounted around one or more pulleys, the cable mechanism having a first end interconnected to a handle mechanism which is mounted at the distal end of the elongated arm mechanism, the first end of the cable mechanism being interconnected to a weight resistance mechanism such that a user may grasp and pull the handle mechanism against an opposing force exerted by the weight resistance mechanism through the cable mechanism.

In accordance with the invention there is provided, a multiple exercise performance apparatus comprising a generally upright stationary frame on which is mounted an elongated arm mechanism for rotation about a generally horizontal axis, the arm mechanism extending from a proximal end to a distal end relative to the frame, the elongated arm mechanism being mounted to a rotatable member which rotates around the generally horizontal axis, the rotatable member being interconnected to a tension member which opposes rotation of the rotatable member.

In accordance with the invention there is provided, a multiple exercise positioning apparatus comprising a generally upright stationary support mounted on a mounting surface, at least one arm mechanism, one end of the arm being fixedly interconnected to the support at a selected height above the mounting surface, the one end of the arm being coupled to the support such that the arm is both rotatable and pivotable relative to the support, wherein the arm has another distal end which is stationarily positionable in a plurality of selected exercise positions via one or both of rotation and pivoting of the arm.

In accordance with the invention there is provided, a multiple exercise performance apparatus comprising a generally upright stationary frame having at least one elongated arm mechanism mounted on the frame mechanism for rotation about an axis extending outwardly from the frame, the arm mechanism extending outwardly from a proximal end to a distal end relative to the frame, wherein a cable mechanism is mounted around one or more pulleys, the cable mechanism having a first terminal end interconnected to a handle mechanism which is mounted at the distal end of the first elongated arm mechanism, and a second terminal end interconnected to a handle mechanism which is mounted at the distal end of the elongated arm mechanism, the cable mechanism being interconnected to a weight resistance mechanism such that user may grasp and pull the handle mechanism against an opposing force exerted by the weight resistance mechanism through the cable mechanism.

In accordance with the invention there is provided, in a multiple exercise positioning apparatus comprising a generally upright support having an elongated arm mechanism pivotably and rotatably mounted to the upright support wherein the elongated arm mechanism has a cable interconnected between a handle disposed at a distal end of the arm and a weight resistance mechanism which is actuated by pulling on the handle, a method of performing any one of a selected number of differently positioned or oriented exercises with the apparatus comprising positioning the elongated arm in a selected position of rotation around an axis of rotation of the arm, positioning the elongated arm in a selected position of pivot about an axis of pivot of the arm, manually pulling on the handle so as to exert an opposing force to the weight resistance mechanism through the cable.

BRIEF DESCRIPTION OF THE DRAWINGS

The accompanying pictures/drawings depict and disclose examples of the invention and examples of various positions and uses of the invention wherein.

DETAILED DESCRIPTION OF EMBODIMENTS

Figure 1:
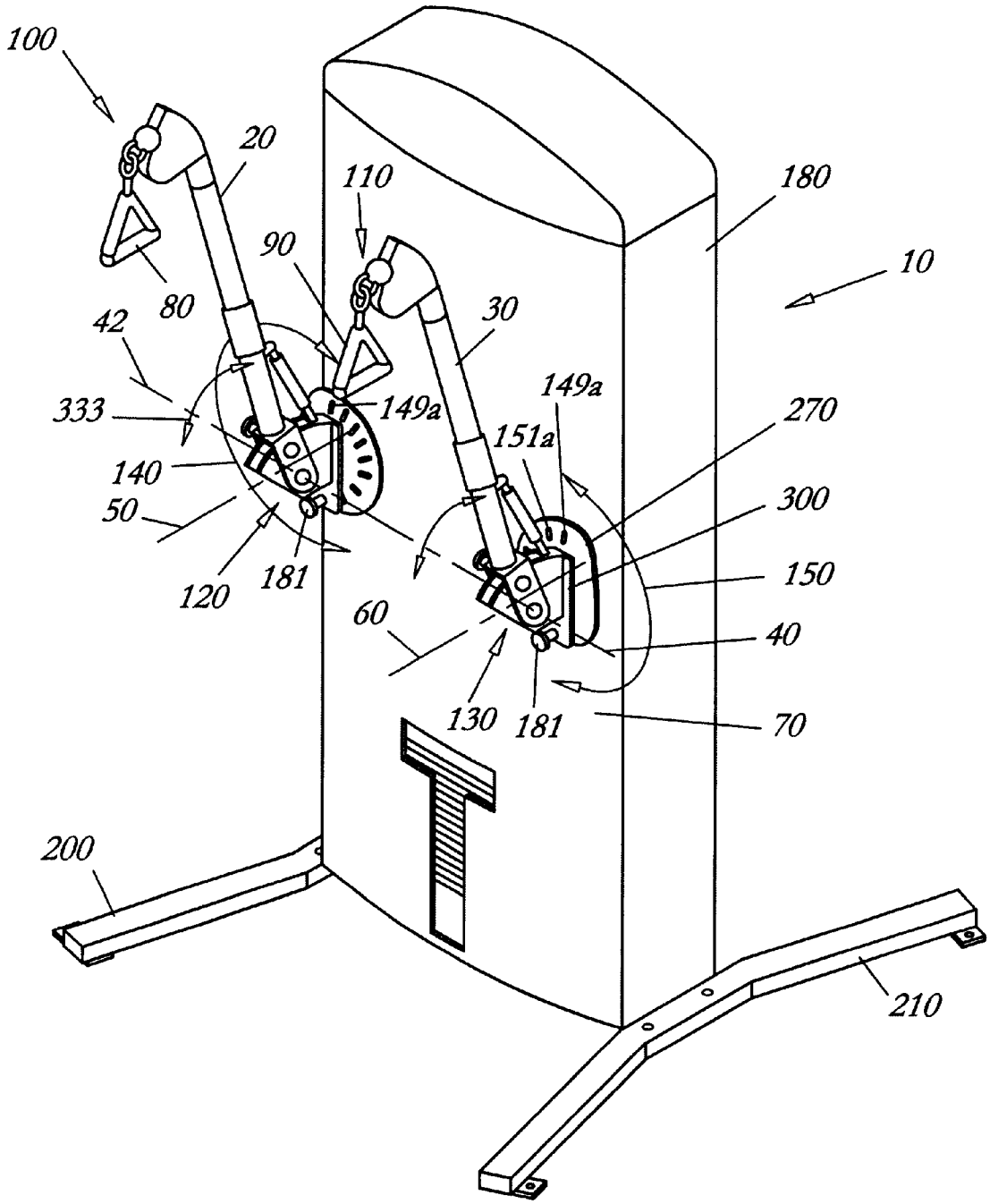
FIG. 1 is a perspective front left view of an apparatus according to the invention.

FIG. 1 shows a functional trainer or multi-exercise function apparatus 10 according to the invention comprising a pair of right 20 and left 30 arms which are both pivotable respectively around axes 42, 40 and both rotatable respectively around axes 50 and 60. As shown axes 40 and 42 are collinear/coaxial but do not necessarily need to be collinear or coaxial. The apparatus has a front face 70 in front of which the user normally stands or is otherwise positioned when using the apparatus 10 so as to have manual access to the handles 80, 90 held at the distal ends 100, 110 of each arm 20, 30 respectively. As shown in FIG. 1, the arms 20, 30 extend forwardly from the front face 70 from a pivot end 120, 130 which is/are proximal to the front face 70 to the distal ends 100, 110 which are forwardly extending relative to the face 70; and the arms. 20, 30 are rotatable in semi-circular arcs 140, 150 around axes 50, 60 which project forwardly of the frontal face 70. As can be readily imagined when the arms are pivoted in a position out of vertical as shown in FIG. 1 for example, the arms 20, 30 will travel through a half conical path when rotated fully through the semicircular arcs 140, 150. The upright frame elements, 160, 170, FIG. 6, on which the arms 20, 30 are rotatably mounted and the cover 180 and other components are generally mounted are themselves mounted or rigidly attached to leg supports 200, 210 which are seated on the ground as shown.

Figure 2:
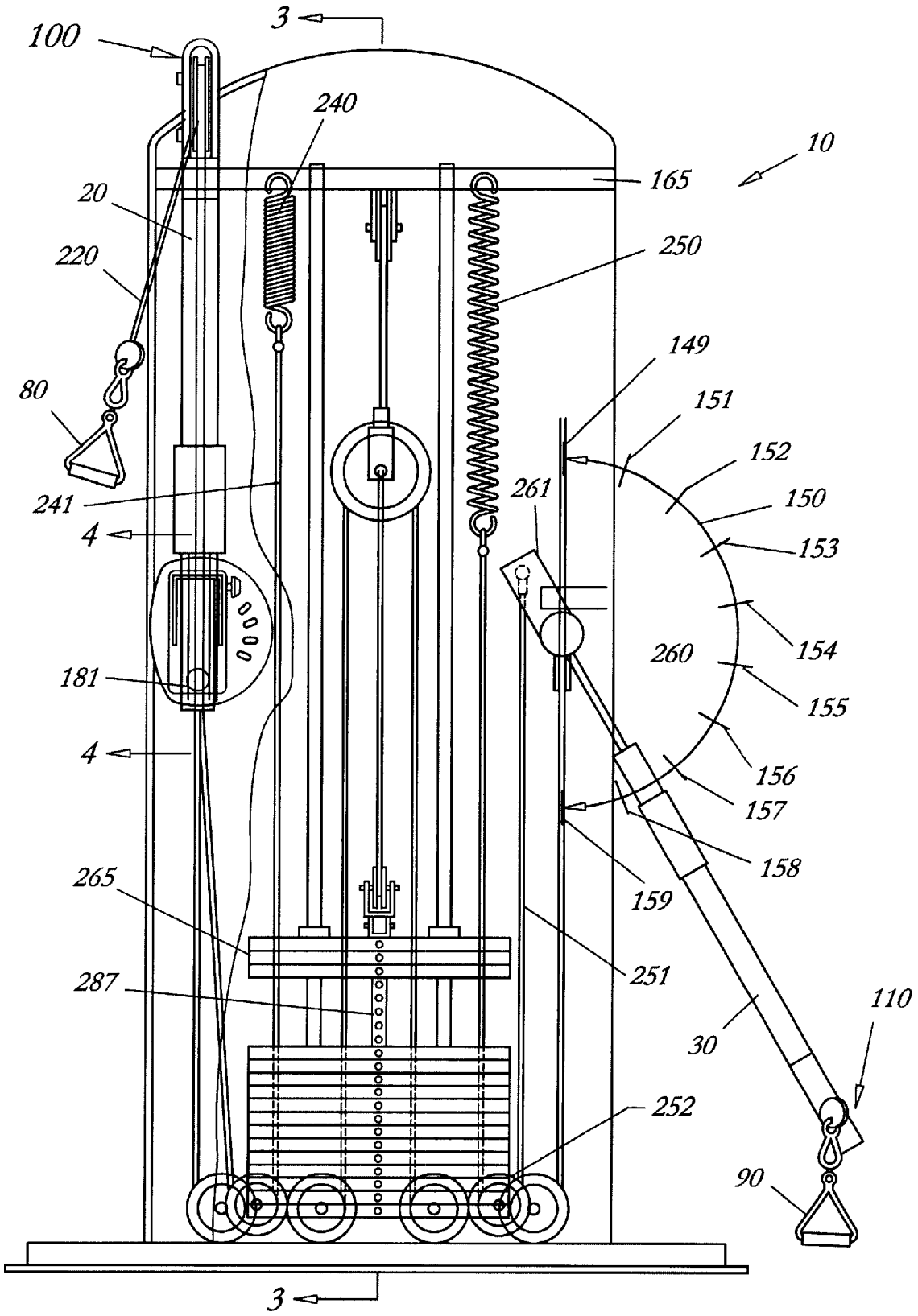
FIG. 2 is front cut-away view of the FIG. 1 apparatus showing the pair of pivotable/rotatable handle positioning arms in selected rotated and pivoted positions and showing the cabling interconnection arrangement with several incremental weight plates in a weight stack being lifted by the pulled out cable from the end of one of the arms.

As shown in FIG. 2, each arm 20, 30 may be rotated around its rotation axis 50, 60 into locked rotated positions/increments. As shown in FIG. 2, arm 30 is lockable into rotated positions 149 and 151 which are in 20 degree arcuate increments along the entire 180 degree arcuate travel 150 of arm 30. The arms may be locked into any incremental arcuate positions and such locked positions may be of any selected incremental size or degree and may be incrementally the same or different from each other. In the embodiment shown, the locked positions are enabled by bushings 270 which are stationarily attached to frame uprights 160, 170 having incrementally spaced, apertures 149*a*, 151*a* et seq., FIG. 1, which correspond to angular positions 149 and 151, FIG. 2 (apertures corresponding to positions 153–159 not labeled/shown in FIG. 1). A pin 181, FIGS. 1, 3, 4, which is spring 282 loaded and mounted on rotatable axle flange 300, FIGS. 1, 4, is manually insertable into any of the apertures (e.g. 149*a*, 151*a*) in the flanged portion 270 of cylindrical bushing 272, the apertures in flange 270 corresponding to positions 149 and 151, by manually pulling backwardly on the head of the pin 181, releasing the pin and allowing the pin to be spring 282 force inserted into a selected aperture thus locking the rotation position of the rotatable axle 301 around axis 50 into a selected angular position. As shown in FIG. 4, the forwardly extending arm 20 with end portion 24 is pivotably attached at pivot axis 42 to bracket 23 which is in turn fixedly attached to or integrally formed together with the flange portion 300 of the rotatable axle 301. Axle 301 is rotatably mounted within fixedly attached bushing 272 by any conventional mechanism, e.g. by a rotation enabling bearing 25 interposed between the outer surface of axle 301 and the inner surface of fixedly mounted bushing 272, FIG. 4. The cylindrically shaped axle 301 is thus attached to arm 20 via bracket 23 as shown in FIG. 5 and arm 20 is thus rotatable around axis 50 by rotation of axle 301 within bushing 272.

Figure 3:
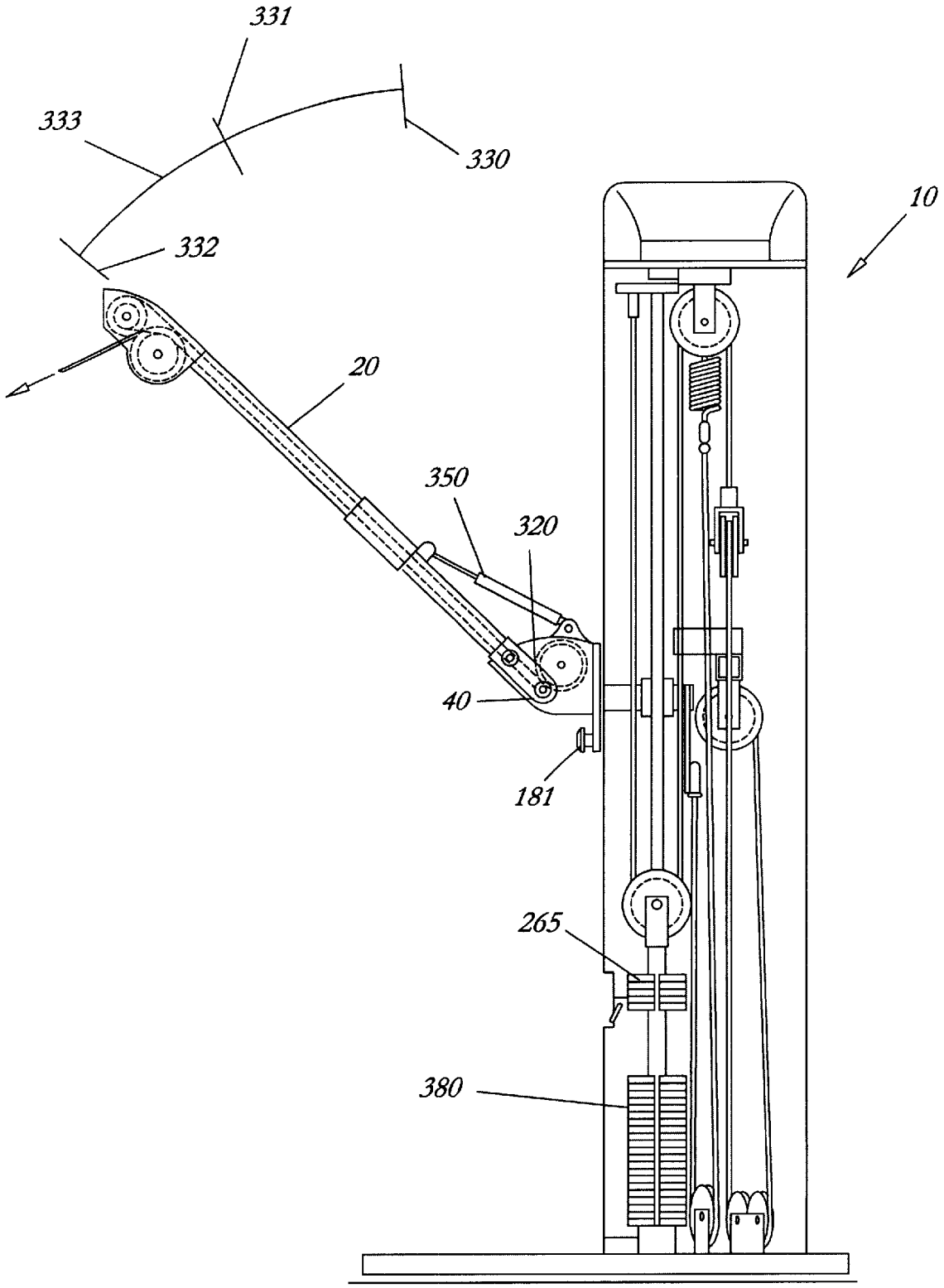
FIG. 3 is a side sectional view of the FIG. 1 apparatus along lines 3—3 of FIG. 2, showing the right side pivotable/rotatable arm in an upwardly pivoted position and the weight lifting handle pulled out a certain length resulting in lifting of a certain number of incremental weight plates from the weight stack.
Figure 4:
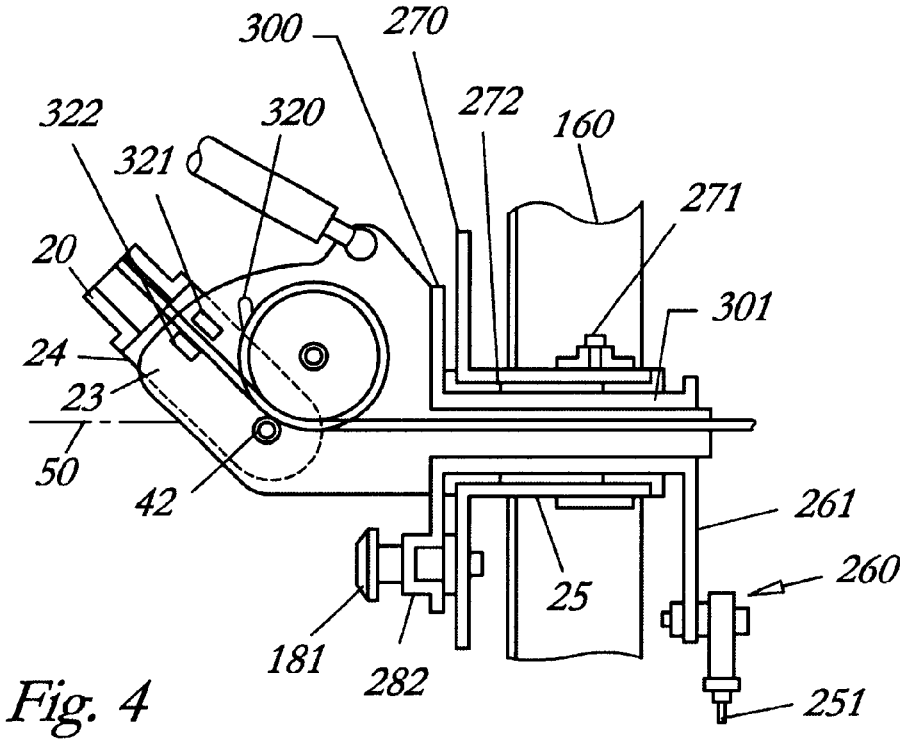
FIG. 4 shows a detail of the relative positioning of the cable and pulley mounted at the pivot position of the right arm of the apparatus along lines for 4—4 of FIG. 12.
Figure 5:
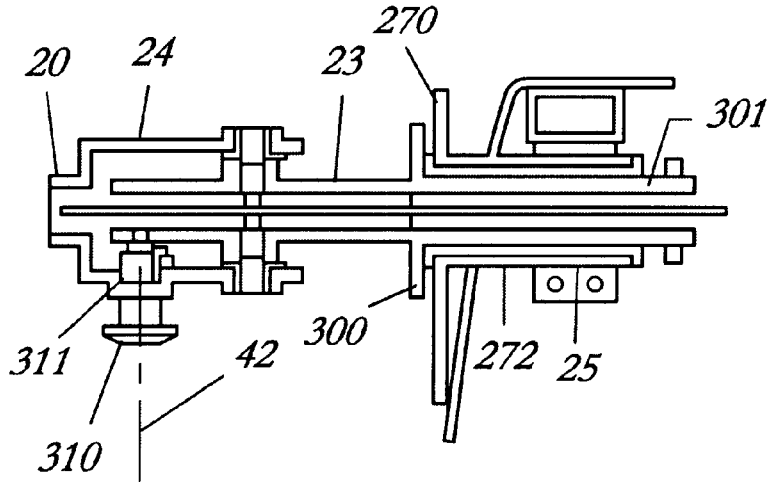
FIG. 5 is a cut-away top view of FIG. 4.

As shown in FIGS. 3–5, arm 20 is pivotable and lockable into incremental arcs around pivot axis 42, e.g. into incremental angular positions 330, 331, 332, FIG. 3, which correspond to the locking of pin 310, FIG. 5, into incremental angular apertures 320, 321, 322 As can be readily imagined, the number, size and degree of the incremental arcuate positions and apertures p rovided for pivoting movement of arms 20, 30 can be varied and selected to be of any desired value. A user can change the pivot position of an arm 20, 30 by pulling outwardly on the exposed head of pin 310 to disengage the inner end of the pin 310 from an aperture, 320, 321, 322, manually pivoting an arm around an axis 40 or 42 to a position where the pin is in axial alignment with a desired aperture 320, 321, 322 and releasing the head of the pin 310 allowing the spring 311, FIG. 5, to snap the tip end of the pin into engagement within the desired pivot position aperture. Preferably the weight of the arms 20, 30 is selected to allow the user to readily pivot the arms 20, 30 to any desired pivot position around axes 40, 42 and to further facilitate such manual pivoting, a pneumatic or hydraulic cylinder, shock absorber or the like 350, FIG. 3 is provided between mounting bracket 23 and arm 20, 30 so as to counterbalance or at least lessen any torque force exerted by the weight of an arm 20, 30 around the pivot axes 40, 42.

As shown by FIGS. 1–6, arms 20, 30 can be rotated and pivoted about axes 50, 60 and 40, 42 such that the distal ends 100, 110 of the arms and their associated handles 80, 90 can be positioned closer to or further away from the face 70 of the apparatus 10 in a wide variety of upward, sideward and downward positions thus enabling the user to self create or choose an exercise for any desired muscle or muscle group, e.g. a pull down exercise where the handles are positioned as shown in FIG. 1, or a pull up exercise when the arms are rotated to a downward position, or a rowing or pull in exercise when the arms are pivoted to a more horizontally disposed position. As can be readily imagined, the arms 20, 30 can be positioned to virtually limitless positions for creating an exercise of the user's choice/selection. The handles 80, 90 can be engaged by the user's foot/feet, head, elbow, etc. when positioned appropriately relative to the position of the user's body on the ground or other implement such as a bench on which the user may sit or lie to perform a chest press or sit up or leg or calf press or other exercise as the user may select.

Incidental rotation of the arms 20, 30 when residing in any given position of rotation is controlled by a safety tension mechanism. As shown in the embodiments in FIGS. 1–6, the rotation axle 301 is provided with a flange plate 261, FIGS. 2, 4, to which is rotatably attached a link 260 which is attached to a cable 251 which is routed around a pulley 252, FIG. 2, which is attached to a stretchable spring 250 which is connected to the frame member 165. When an arm is in a zero rotation torque position, position 149, such as when the arms are in the positions shown in FIG. 1, the flange plate 261 is not rotated around axis 60 and spring or tension member 240 is in a minimum stretch or tension state. In the minimum stretch state, e.g. as shown in FIG. 2 with respect to spring 240, the spring is nevertheless stretched to a certain degree and under tension in the minimum zero torque position of plate 261 so that the arm 20 is held in a steady state position under the tension of tension member 240 or 250 as the case may be. When an arm is rotated out of the zero torque position, e.g. in position of arm 30 shown in FIG. 2, the tension member 250 is further stretched and the tension increased somewhat relative to the minimum stretch position to account for the added rotational torque force exerted by the weight of an arm 20, 30 through axle 301 to plate 261. Preferably the added tension which the tension member 240, 250 undergoes throughout the entirety of the complete arc of rotation of plate 261 is small relative to the maximum tension which the tension member is capable of withstanding or exerting. Preferably the tension which the tension member 240, 250 exerts through to the plate 261 against rotation of an arm 20, 30 in any given position of rotation of plate 261 along arc 150 is less than about ten percent of the maximum tension or upper tension limit value of the tension member. In any event, when an arm is rotated to any position along arc 150 and in any pivot position along arc 333, the tension exerted by the tension member 240, 250 is sufficient to hold the arm in whatever rotated and pivoted position in which it may be residing at the moment, i.e. the weight of the arm 20, 30 and the rotation torque force which the arm may exert on axle 301 in any given rotation and pivot position, is counterbalanced by the opposing tension in tension member 240, 250 such that arm is held in such position and will not drift downwardly or upwardly in the absence of the user's applying a manual or other torque rotation force to an arm. Preferably a user may easily and smoothly rotate an arm to any desired position of rotation against the rotation controlling tension force exerted by the tension member.

Figure 6:
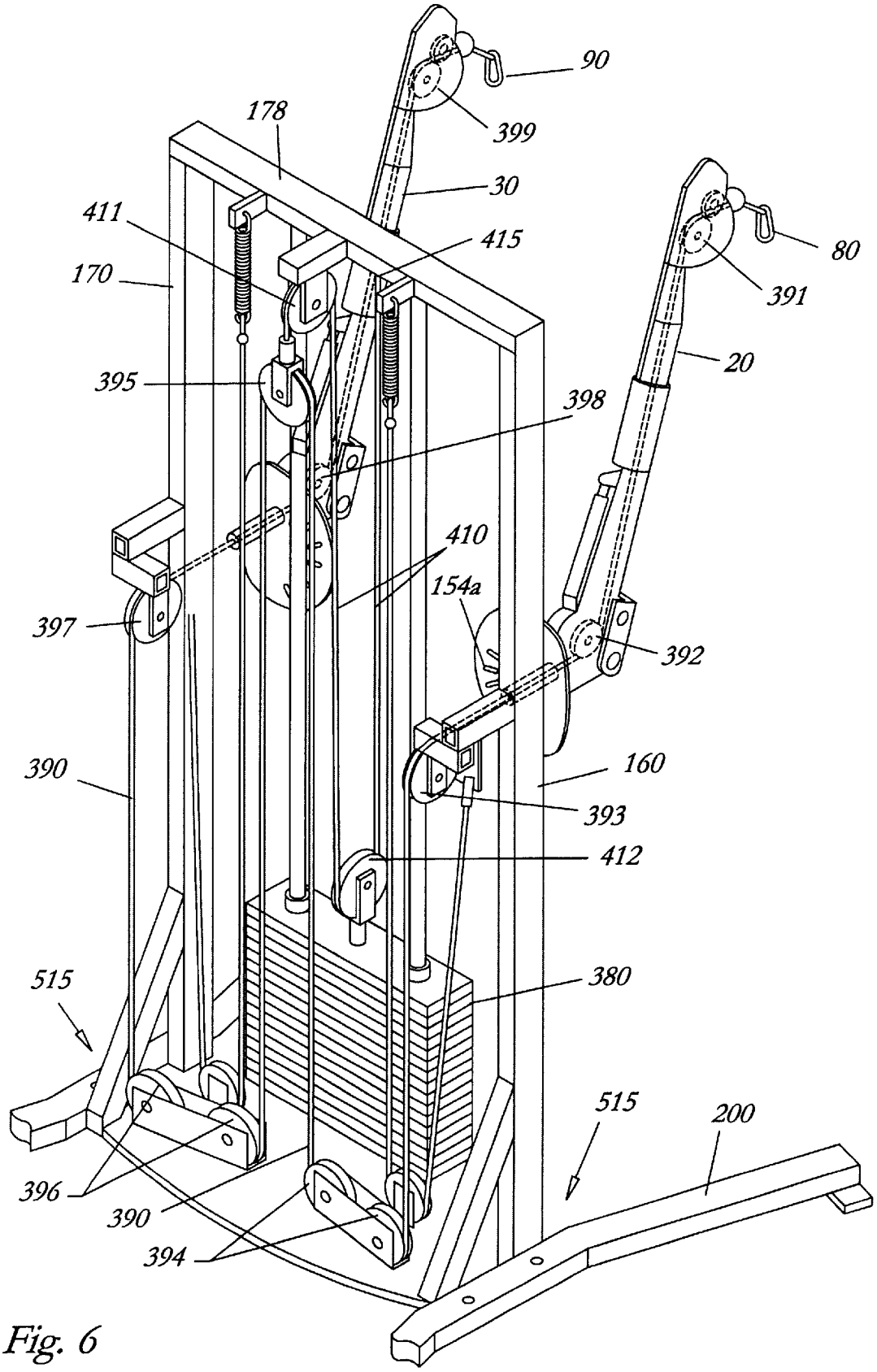
FIG. 6 is a cut away view of the apparatus shown in the position of FIG. 1 showing the details of the rotatable mounting of the pivotable/rotatable arms and the cabling and pulley arrangement interconnections between the handles and the weight stack.

FIG. 6 shows a cabling arrangement for interconnecting the handles 80, 90 to the weight resistance mechanism 380. As shown, a single flexible cable 390 is connected between the handles 80, 90, the cable 390 being routed through the arms 20, 30 and through/past the pivot positions where the pivot axes 40, 42 are located. The single cable 390 is further routed around a series of pulleys 391–399 which are all mounted such that when either handle 80, 90 is pulled outwardly from the distal ends of the arms, the cable 390 necessarily pulls downwardly on pulley 395 which is connected to a second cable 410 which is routed around pulleys 411, 412 and interconnected at its distal end 415 to the frame member 178. As pulley 395 is pulled downwardly, pulley 20 412 is pulled upwardly. Pulley 412 is connected to the weight resistance mechanism 380 and, when pulley 412 is pulled upwardly, the weight resistance mechanism 380 is pulled upwardly along with pulley 412 via the weight bearing rod 287, FIG. 2, thus creating the opposing force to the user's pulling on one or both of the handles. As can be readily imagined and shown in FIG. 7, both handles can be pulled outwardly at the same time, both such pulling motions, 425, 426 resulting in a simultaneous downward pulling 418, 419 on pulley 395 and concomitant lifting 417 of pulley 412. Similarly, pulling 435, FIG. 8, on a single handle results in downward pulling force 421 on pulley 395. As shown, all of the routing pulleys for the single cable 390 which extend between the handles, i.e. pulleys 391, 392, 393, 394 and 396, 397, 398, 399 and the routing pulley 411 are connected or anchored to a stationary component of the apparatus. Pulleys 395 and 412 are floating enabling upward pulling of the weight resistance mechanism 380.

Figure 7:
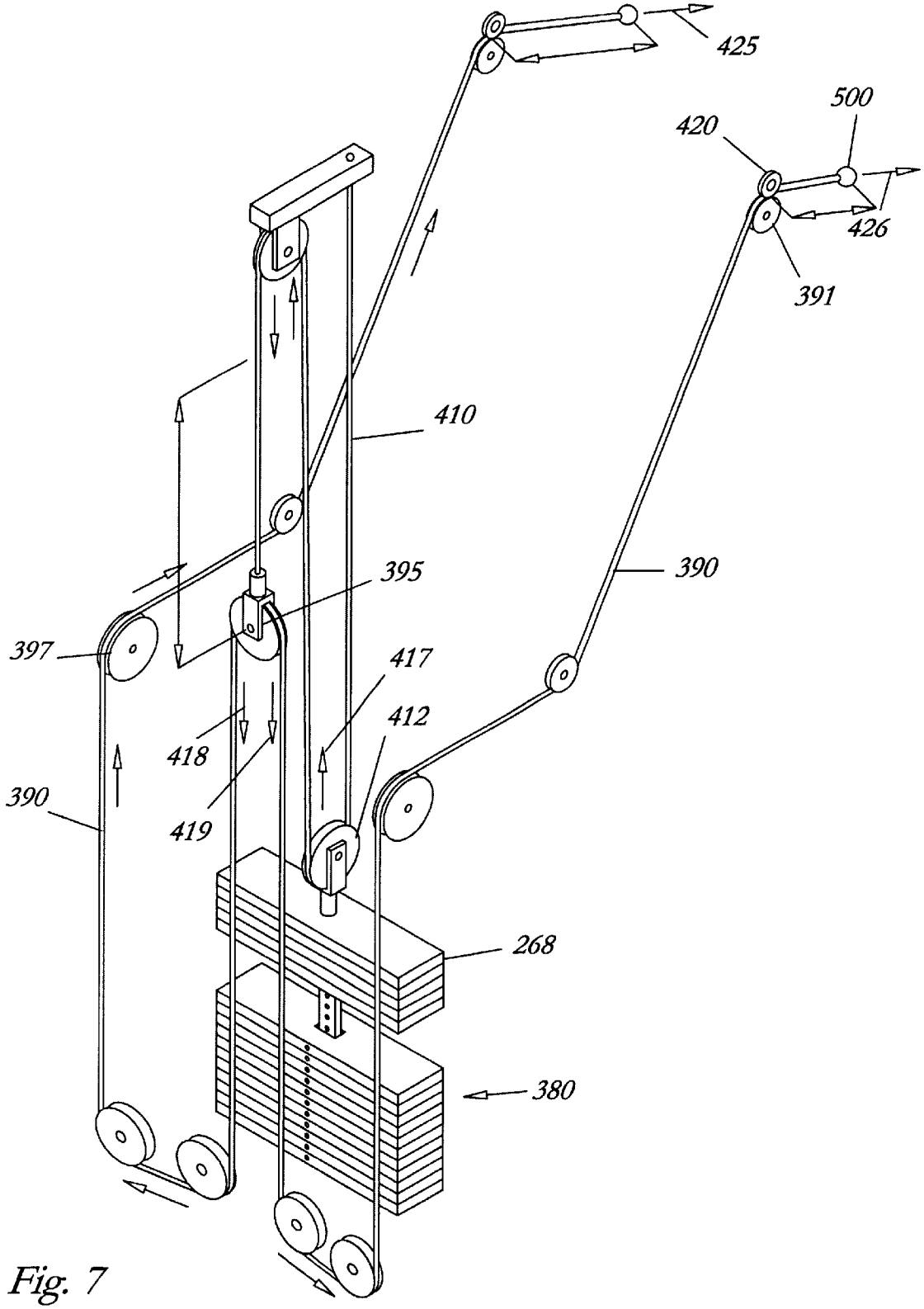
FIG. 7 is a schematic view of the cabling independent of the frame and arms structures where the handles of both arms are pulled out from the distal ends of the arms.
Figure 8:
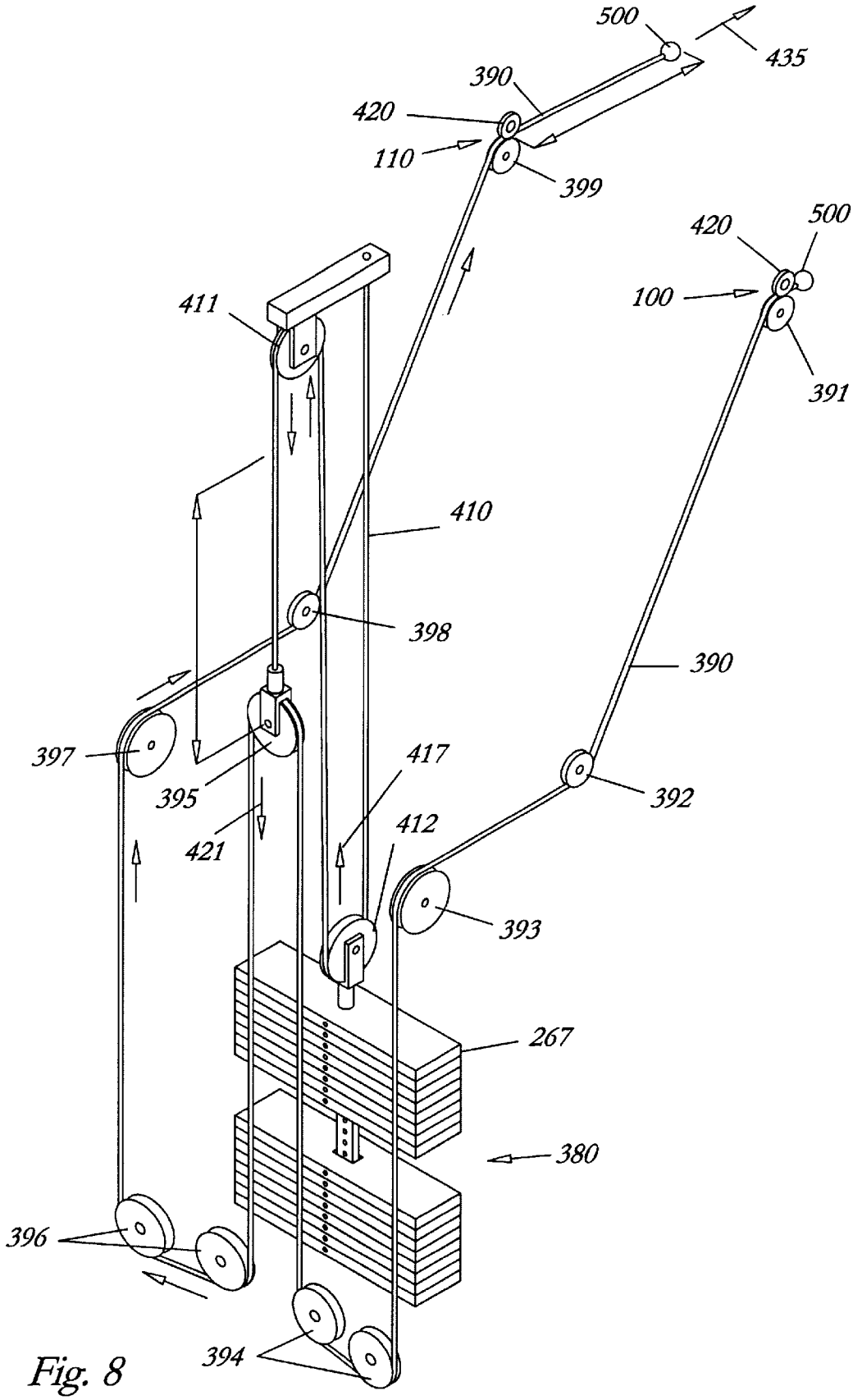
FIG. 8 is a schematic view of the cabling independent of the frame and arm structures where the handle of one arm is pulled out and the handle of the of the other arm is not pulled out from the distal end of the arm.

As shown in FIGS. 7, 8 the terminal ends of the cable 390 are provided with stops 500 attached to cable 390. Follower pulleys 420 are also mounted on the ends 100, 110 of arms 20, 30 so as to cooperate with pulleys 391 to provide an interference mechanism for stops 500 thus limiting the backward movement of the terminal ends of cable 390 (to which the handles 80, 90 are attached) beyond the position of pulleys 391, 420 and 399, 420.

The weight resistance mechanism 380 shown in the embodiment of the Figures comprises a stack of incremental weights any selected number of which a user can interconnect to pulley 412 before beginning an exercise, e.g. by inserting a pin through a lateral aperture which is provided in each of the incremental weights in the stack and continuing through a complementarily aligned aperture provided in the rod 287, FIG. 2, for each incremental weight, the weight bearing rod 287 being interconnected to pulley 412. Other weight resistance mechanisms can be provided such as free weights, a high tension springs, a high tension stretch or compression member, a force resistance rotating mechanism, a container fillable with a selected amount of fluid or the like.

The horizontal foot supports 210, 200 are rigidly connected to the upright frame supports 160, 170 at a generally right angle and have a length extending from the point of connection 515, FIG. 6 selected to safely oppose any rotating torque force around the point of connection 515 that might tend to tip the upright supports 160, 170 over.

What is claimed is:

1. A multiple exercise performance or positioning apparatus comprising:

a generally upright stationary frame having a front, a back, a first side, and a second side;

an elongated arm mechanism having a proximal end and a distal end;

a pivot mechanism secured to the generally upright stationary frame and to the elongated arm mechanism, wherein the pivot mechanism is interposed between the front of the generally upright stationary frame and the proximal end of the elongated arm mechanism, wherein the pivot mechanism rotates about a first axis that extends horizontally through the front and back of the generally upright stationary frame, the elongated arm mechanism pivotally mounted to the pivot mechanism to pivot about a second axis that is transverse to the first axis, wherein the elongated arm mechanism is selectively locked into incremental angular positions about the first axis;

a pulley disposed within the pivot mechanism to rotate about a third axis that is separated from, and parallel to, the second axis; and a cable reeved around the pulley within the pivot mechanism and having a first end interconnected to a handle at the distal end of the elongated arm mechanism, the cable interconnected to a weight resistance mechanism to resist movement of the handle relative to the elongated arm mechanism.

2. The apparatus of claim 1, wherein the apparatus further includes a second elongated arm mechanism having a proximal end and a distal end;

a second pivot mechanism secured to the generally upright stationary frame and to the second elongated arm mechanism, wherein the second pivot mechanism is separated laterally from the first pivot mechanism and is interposed between the front of the generally upright stationary frame and the proximal end of the second elongated arm mechanism, wherein the second pivot mechanism rotates about a fourth axis that extends horizontally through the front and back of the generally upright stationary frame, and wherein the second elongated arm mechanism pivots about a fifth axis that is transverse to the fourth axis; and a second pulley disposed within the second pivot mechanism and rotatable about a sixth axis that is separated from, and parallel to, the fifth axis.

* * * * *